US006736687B2

(12) United States Patent
Hauschildt

(10) Patent No.: US 6,736,687 B2
(45) Date of Patent: May 18, 2004

(54) METHOD FOR DISCHARGING WASTE GAS FROM SUBMARINES WITHOUT A SIGNATURE

(75) Inventor: Peter Hauschildt, Schönkirchen (DE)

(73) Assignee: Howaldtswerke-Deutsche Werft AG, Kiel (DE)

( * ) Notice: Subject to any disclaimer, the term of this patent is extended or adjusted under 35 U.S.C. 154(b) by 0 days.

(21) Appl. No.: 10/203,663

(22) PCT Filed: Nov. 5, 2001

(86) PCT No.: PCT/DE01/04140

§ 371 (c)(1),
(2), (4) Date: Oct. 2, 2002

(87) PCT Pub. No.: WO02/46034

PCT Pub. Date: Jun. 13, 2002

(65) Prior Publication Data

US 2003/0119388 A1 Jun. 26, 2003

(30) Foreign Application Priority Data

Dec. 9, 2000 (DE) ..... 100 61 487

(51) Int. Cl.[7] ..... B63H 21/32
(52) U.S. Cl. ..... 440/89 B; 114/337; 114/15
(58) Field of Search ..... 114/15, 337; 440/89 B

(56) References Cited

U.S. PATENT DOCUMENTS 2,020,788 A 11/1935 Konstantinoff

FOREIGN PATENT DOCUMENTS

| | | | |
|---|---|---|---|
| DE | 26 58 484 | 6/1978 | ..... B63H/21/32 |
| EP | 0 752 565 B1 | 1/1997 | ..... F25J/3/04 |

OTHER PUBLICATIONS

XP 000287420 Maschinenbau, Schiff & Hafen/SEE-WIRTSCHAFT, Heft Jul. 1992 P. 43–46.

*Primary Examiner*—Jesus D. Sotelo
(74) *Attorney, Agent, or Firm*—Cohen, Pontani, Lieberman & Pavane

(57) ABSTRACT

The invention relates to a method and a device for discharging signature free exhaust gas from underwater vehicles, the exhaust gas being a by-product of the production of electric energy in energy converters and being directed by means of pressure into a pipe length through which outboard water is flowing. Gas bubbles of the exhaust gas in the at least one pipe length are reduced using static mixers arranged inside of the pipe length through which water is flowing, with the gas being dissolved by the high turbulence of the fluid. As the exhaust gas is dissolved inside of the underwater vehicle, no gas bubbles that might be located are produced outside the vehicle. Since the working pressure of the method equals the immersion pressure in the pipe, the method consumes only a small amount of energy.

12 Claims, 2 Drawing Sheets

METHOD FOR DISCHARGING WASTE GAS FROM SUBMARINES WITHOUT A SIGNATURE

PRIORITY CLAIM

This is a U.S. national stage of application No. PCT/DE01/04140, filed on Nov. 5, 2001. Priority is claimed on that application and on the following application: Country: Germany, Application No.: 100 61 487.6, Filed: Dec. 9, 2000.

BACKGROUND OF THE INVENTION

1. Field of the Invention

The invention relates to a method and a device for discharging signature free exhaust gas from underwater vehicles, said exhaust gas being a by-product of the production of electric energy in energy converters, and to such an underwater vehicle.

2. Description of the Prior Art

When using hydrocarbons for delivering energy, energy converters, which serve to produce electricity in underwater vehicles without having to rely on outside air, not only produce electricity but also exhaust gas.

Said exhaust gas must be stored on board or discharged from the vehicle. The solutions heretofore proposed are water management systems, the liquefaction of the exhaust gas and subsequent storage thereof or the direct discharge in the form of gas.

The document EP 0 752 565 B1 for example discloses an apparatus for the disposal of $CO_2$ in underwater vehicles. To dispose of the $CO_2$ in underwater vehicles, pressurized water has to be ingested from the outside into the underwater vehicle where it dissolves $CO_2$ with the assistance of an absorber after which this water, containing the dissolved $CO_2$, is to be redirected out of the vessel against the immersion pressure.

According thereto, there is provided an apparatus that has a housing which is provided with a circular internal tread for a rotating cam body, said internal tread being disrupted by opposite pairs of water inlet ports and water outlet ports, each water inlet port being separated from the water outlet port by a vane that is radially slidable on the cam body and a respective one of the inlet ports for high-pressure water alternating with an outlet port for low-pressure water and a respective one of the inlet port for low-pressure water alternating with an outlet port for high-pressure water on the circular internal tread of the housing. This apparatus is characterized in that it is provided with but a few movable parts and sealing surfaces and that it permits, with low internal flow resistance and without flow reversal, harmonious flow of the water transported for the disposal of $CO_2$, with the water bearing parts of the apparatus being treated with care and subjected to little strain as a result thereof.

In Schiff & Hafen/Seewirtschaft (Ship and Harbour/Sea Trade), Part 7/1992, pp. 43–46, the contribution "Der Kreislaufdiesel als außenluftunabhängiger Antrieb für U-Boote" (Recirculation diesel as an air independent drive for submarines) describes a water management system that is suited to take in sea water for the absorbers and to release it again out of the vehicle. This water management system uses the energy of the sea water subjected to immersion pressure. The arrangement consists of control valves and of freely movable pistons that allow the diesel recirculation system to operate independent of the immersion depth. The feed pumps for the intake of sea water only need to compensate the resistances of the pipelines and of the fittings.

These systems require either lots of space or lots of energy or they result in signatures that make it easy to locate the underwater vehicle.

SUMMARY OF THE INVENTION

It is therefore the object of the present invention to discharge exhaust gas with low signature from the vehicle while requiring little space and energy.

In accordance with the invention, the solution of this objection is achieved by a method for discharging signature free exhaust gas from an underwater vehicle having an energy converter for producing electric energy, the exhaust gas being a by-product of the energy converter. The method comprises the steps of supplying outboard water to at least one pipe having a pipe length between an inlet and an outlet, directing the exhaust gas into the at least one pipe using pressure and generating gas bubbles of the exhaust gas in the at least one pipe, and reducing the generated gas bubbles so that the gas is dissolved by high turbulence of the output water in the at least one pipe using static mixers arranged in the at least one pipe.

Accordingly, the invention includes a method for discharging signature free exhaust gas from underwater vehicles, said exhaust gas being a by-product of the production of electric energy in energy converters and being directed by means of pressure into a pipe length through which outboard water is flowing. The thereby generated gas bubbles are reduced by means of static mixers arranged inside of the pipe length through which water is flowing, with the gas being dissolved by the high turbulence of the fluid.

As the exhaust gas is dissolved inside of the underwater vehicle, no gas bubbles that might be located are produced outside the vehicle. Since the working pressure of the method equals the immersion pressure, but little energy is consumed.

According to a preferred feature of the invention, the exhaust gas is introduced into the pipe length by way of a porous body, the exhaust gas being introduced into the pipe length at a pressure that preferably is above the immersion pressure.

The pipe length is thereby supplied with outboard water (sea water) by way of a pump. According to a particular feature, the pipe length is supplied with outboard water (sea water) by the moving underwater vehicle, the outboard water being subjected to immersion pressure between the inlet and the outlet point. According to another feature, the flow velocity of the water inside the pipe length preferably amounts to 1–3 m/s.

The invention also comprises a device for discharging signature free exhaust gas from underwater vehicles, said exhaust gas being a by-product of the production of electric energy in energy converters. For the purpose thereof, at least one pipe length is arranged in the underwater vehicle, said pipe length being provided with an inlet for outboard water (sea water), an outlet for the exhaust dissolved in the water, and an injection site for the exhaust gas to be introduced into the pipe length. At least one static mixer is provided inside of said pipe length. According to another feature, a pump is arranged in the region of the inlet port for the outboard water of the pipe length. In accordance with another feature of the invention, the injection site consists of a quadrant pipe with an injection lance and a porous body. According to a preferred feature of the invention, the length of the pipe is such that it allows complete dissolution of the gas bubbles of the exhaust.

BRIEF DESCRIPTION OF THE DRAWINGS

The invention will be described more explicitly in the following with the help of an embodiment illustrating an example and represented in the FIGS. in which.

DETAILED DESCRIPTION OF THE PRESENTLY PREFERRED EMBODIMENTS

Figure 1:
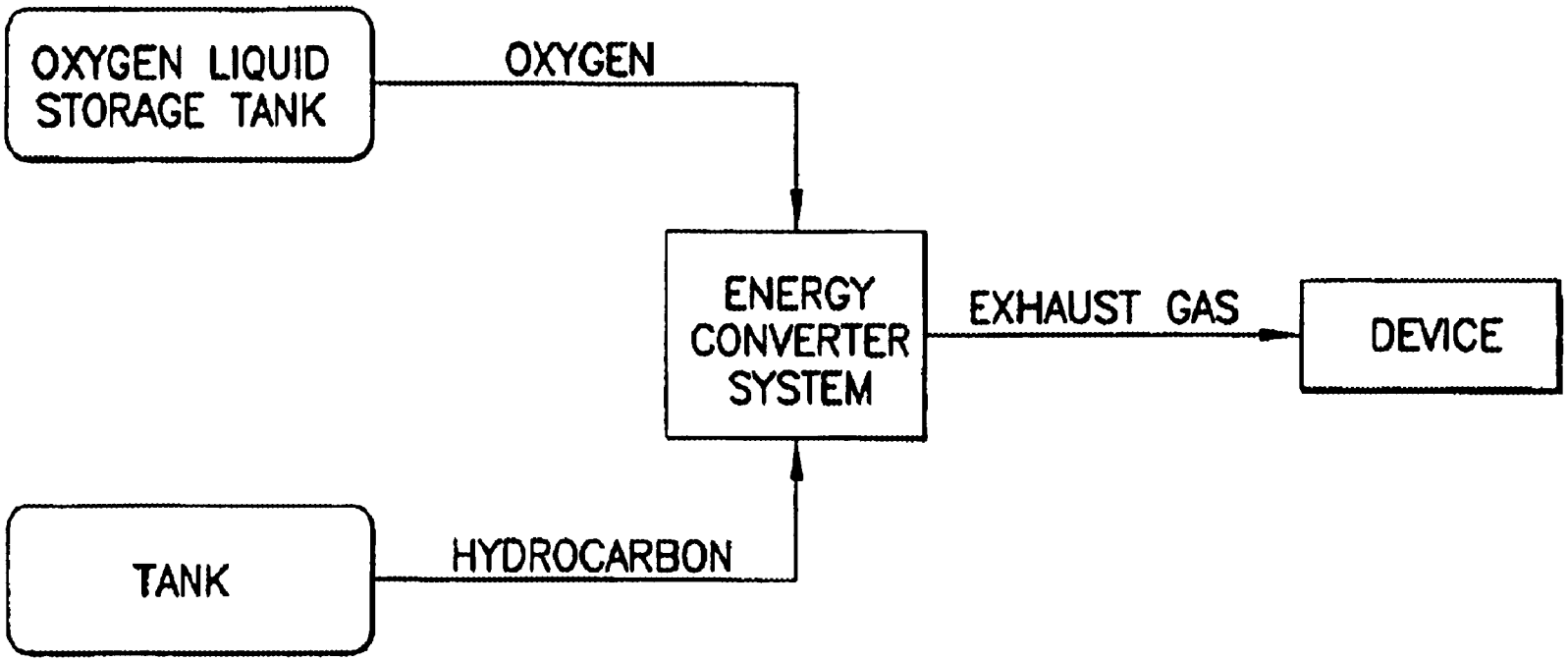
FIG. 1 is a block diagram showing an independent energy supply.
Figure 2:
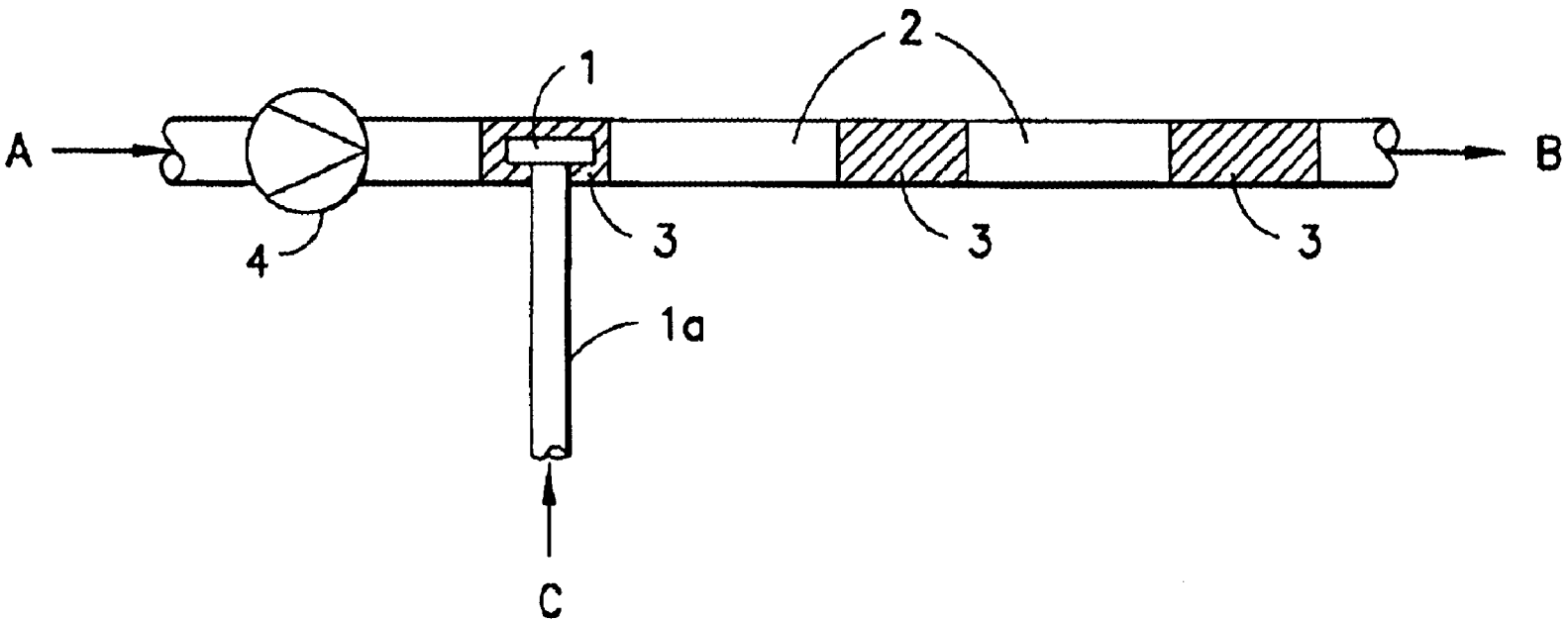
FIG. 2 is a schematic diagram showing the device for discharging the exhaust gas according to the present invention.

In an energy converter system III for producing electric energy in an underwater vehicle that is supplied with oxygen a from an oxygen liquid storage tank I and with a hydrocarbon b from a tank II, electric energy and heat are obtained together with a by-product exhaust gas c as a result of the reaction of hydrocarbon with oxygen, said exhaust gas consisting, aside from water, mainly of carbonic acid. Said exhaust gas is dissolved in water in the device IV and then released out of the vehicle in accordance with the method according to claim 1

For this purpose, sea water is made to flow through a pipe length 2 from inlet A to outlet B by means of a pump 4 or by the moving vehicle. Suitable flow velocities range between 1 and 3 m/s. Immersion pressure prevails at the inlet and at the outlet port. The exhaust gas C is discharged at a pressure above immersion pressure through a quadrant pipe including an injection lance 1*a* and a porous body 1 arranged inside of said pipeline. Sufficient pressure is thereby achieved by way of an appropriate method in the energy converter III or of a compressor in the exhaust gas stream c.

The quantity of sea water is determined in such a manner that the water is capable of completely dissolving the exhaust gas on account of its solvent power for gases. The quantity of water needed thereby depends on the composition of the exhaust gas, the temperature of the water and the immersion pressure.

In using static mixers 3 in pipe 2, the bubbles forming from the gas C are very small (<3 mm) and are prevented from combining into greater bubbles by the high turbulence generated by means of the mixers. The high turbulence and a sufficient length of the pipe of about 30 m for example cause the bubbles inside the pipe to completely dissolve. Accordingly, gas that might be located no longer exits site B.

What is claimed is:

1. A method for discharging signature free exhaust gas from an underwater vehicle having an energy converter for producing electric energy, the exhaust gas being a by-product of the energy converter, said method comprising the steps of:

supplying outboard water to at least one pipe having a pipe length between an inlet and an outlet;

directing the exhaust gas into the at least one pipe using pressure and generating gas bubbles of the exhaust gas in the at least one pipe; and reducing the generated gas bubbles using static mixers arranged in the at least one pipe so that the gas is dissolved by high turbulence of the output water in the at least one pipe.

2. The method of claim 1, wherein said step of directing comprises introducing the exhaust gas into the at least one pipe length through a porous body.

3. The method of claim 1, wherein said step of supplying outboard water comprises pumping the outboard water with a pump.

4. The method of claim 3, wherein said step of supplying outboard water includes supplying the outboard water so that the outboard water flows through the at least one pipe at a velocity within the range including 1–3 meters/second.

5. The method of claim 1, wherein said step of supplying outboard water comprises supplying the outboard water using an immersion pressure generated between the inlet and the outlet by movement of the underwater vehicle through the outboard water.

6. The method of claim 5, wherein said step of supplying outboard water includes supplying the outboard water so that the outboard water flows through the at least one pipe at a velocity within the range including 1–3 meters/second.

7. The method of claim 1, wherein said step of supplying outboard water includes supplying the outboard water so that the outboard water flows through the at feast one pipe at a velocity within the range including 1–3 meters/second.

8. The method of claim 1, wherein an immersion pressure is present in the at least one pipe between said inlet and said outlet and said step of directing comprises introducing said exhaust gas into the at least one pipe at a pressure above the immersion pressure.

9. A device for discharging signature free exhaust gas from and underwater vehicle having an energy converter for producing electric energy, the exhaust gas being a by-product of the energy converter, said device comprising:

at least one pipe having a pipe length with an inlet for receiving outboard water and an outlet for discharging the exhaust gas dissolved in the received outboard water;

an injection site for introducing the exhaust gas into the at least one pipe and generating gas bubbles of the exhaust gas in the at least one pipe; and a static mixer arranged inside said at least one pipe between said inlet and said outlet.

10. The device of claim 9, further comprising a pump arranged proximate said inlet of said at least one pipe.

11. The device of claim 9, said injection site comprises a quadrant pipe having an injection lance and a porous body.

12. The device of claim 9, wherein said pipe length is sufficient for allowing complete dissolution of the gas bubbles of the exhaust gas in the outboard water in said at least one pipe.

* * * * *